US009573292B2

(12) United States Patent
O'Banion et al.

(10) Patent No.: US 9,573,292 B2
(45) Date of Patent: Feb. 21, 2017

(54) TABLE SAW GUARD

(71) Applicant: BLACK & DECKER INC., Newark, DE (US)

(72) Inventors: Michael L. O'Banion, Westminster, MD (US); Warren A. Ceroll, Owings Mills, MD (US); James R. Parks, White Hall, MD (US); Robert Alan Berry, Fincastle, VA (US); Robert P. Welsh, Phoenix, MD (US); Daniel Puzio, Baltimore, MD (US); Michael L. Agronin, Owings Mills, MD (US); Philip T. Miller, Phoenix, MD (US); Robert J. Opsitos, Jr., New Freedom, PA (US); Andrew E. Seman, Jr., Pylesville, MD (US); John K. Horky, Lutherville, MD (US); James P. Bascom, Brecksville, OH (US); Todd J. Huston, Lutherville, MD (US); Matthew C. Webster, Pawtucket, RI (US); Adan Ayala, Idlewylde, MD (US)

(73) Assignee: Black & Decker Inc., New Britain, CT (US)

( * ) Notice: Subject to any disclaimer, the term of this patent is extended or adjusted under 35 U.S.C. 154(b) by 148 days.

(21) Appl. No.: 14/242,372

(22) Filed: Apr. 1, 2014

(65) Prior Publication Data

US 2014/0208904 A1 Jul. 31, 2014

Related U.S. Application Data

(62) Division of application No. 12/621,650, filed on Nov. 19, 2009, now Pat. No. 8,726,776, which is a division (Continued)

(51) Int. Cl.
*B27G 19/02* (2006.01)
*B27G 19/08* (2006.01)

(52) U.S. Cl.
CPC ..... *B27G 19/02* (2013.01); *B27G 19/08* (2013.01); *Y10T 83/2077* (2015.04);

(Continued)

(58) Field of Classification Search
CPC ..... B27G 19/02; B27G 19/08; Y10T 83/2077; Y10T 83/773; Y10T 83/8723; Y10T 83/96; Y10T 83/7734; Y10T 83/8722; Y10T 83/732

(Continued)

(56) References Cited

U.S. PATENT DOCUMENTS 321,484 A 7/1885 Comer
648,000 A 4/1900 Thomas (Continued)

*Primary Examiner* — Omar Flores Sanchez
(74) *Attorney, Agent, or Firm* — Harness, Dickey & Pierce, PLC

(57) ABSTRACT

A table saw guard assembly for guarding a blade on a table saw is provided. The table saw guard assembly includes a support structure and a hood assembly including at least one of a front curtain, first side curtain, second side curtain and top curtain, wherein each of said curtains are independently moveable and/or removable from the hood assembly. Furthermore, a table saw guard assembly is provided including a quick release mechanism for connecting the hood assembly to the support structure.

12 Claims, 15 Drawing Sheets

Related U.S. Application Data of application No. 10/829,605, filed on Apr. 22, 2004, now Pat. No. 7,665,393.

(52) U.S. Cl.
CPC ..... *Y10T 83/773* (2015.04); *Y10T 83/7734* (2015.04); *Y10T 83/8722* (2015.04); *Y10T 83/8723* (2015.04); *Y10T 83/96* (2015.04)

(58) Field of Classification Search
USPC ..... 83/102.1, 545, 546, 544, 546.1, 478,83/477.2, 860; 144/251.1, 25, 251.3
See application file for complete search history.

(56) References Cited

U.S. PATENT DOCUMENTS

| | | | | |
|---|---|---|---|---|
| 660,481 | A | 10/1900 | Barnard | |
| 1,255,886 | A | 2/1918 | Jones | |
| 1,258,961 | A | 3/1918 | Tattersall | |
| 2,095,330 | A | 10/1937 | Hedgpeth | |
| 2,731,049 | A | 1/1956 | Akin | |
| 2,823,711 | A | 2/1958 | Kaley | |
| 3,105,530 | A | 10/1963 | Peterson | |
| 3,249,134 | A | 5/1966 | Vogl et al. | |
| 3,348,836 | A | 10/1967 | Smierciak | |
| 3,606,718 | A | 9/1971 | Curran | |
| 3,845,554 | A | 11/1974 | Joanis et al. | |
| 3,880,032 | A | 4/1975 | Green | |
| 4,206,672 | A | 6/1980 | Smith | |
| 4,467,686 | A | 8/1984 | Pyle | |
| 5,317,944 | A | 6/1994 | Hewitt | |
| 6,131,629 | A | 10/2000 | Puzio et al. | |
| 6,170,370 | B1 * | 1/2001 | Sommerville | B27G 19/08 403/409.1 |
| 6,405,624 | B2 | 6/2002 | Sutton | |
| 6,578,460 | B2 | 6/2003 | Sartori | |
| 6,736,042 | B2 | 5/2004 | Behne et al. | |
| 2002/0104178 | A1 | 8/2002 | Truan et al. | |
| 2003/0024364 | A1 | 2/2003 | Chang | |
| 2004/0011177 | A1 | 1/2004 | Huang | |
| 2005/0211034 | A1 * | 9/2005 | Sasaki | B27G 19/02 83/102.1 |
| 2006/0032355 | A1 * | 2/2006 | Wang | B23D 45/067 83/471.1 |

* cited by examiner

TABLE SAW GUARD

CROSS-REFERENCE TO RELATED APPLICATIONS

This application is a divisional of U.S. patent application Ser. No. 12/621,650 filed on Nov. 19, 2009, which is a divisional of U.S. patent application Ser. No. 10/829,605 filed on Apr. 22, 2004, the disclosures of which are incorporated herein by reference.

FIELD

The present invention relates generally to table saw guard assemblies and specifically to modular table saw guard assemblies for preventing a user from accidentally engaging the table saw blade.

BACKGROUND

Table saw guards have been designed to prevent an operator from accidentally engaging a table saw blade. The typical table saw guard includes a one piece hood pivotally connected to a support structure, whereby introducing a workpiece to the front of the hood causes it to rise. While these guards provide adequate protection, they tend to be cumbersome and often impede visibility to the saw blade. Furthermore, these guards can occasionally bind when cutting miter or bevel angles. Hence, to avoid these obstacles, operators often remove the hood assembly.

SUMMARY

One aspect of the present invention provides a table saw guard assembly having independently moveable side curtains. Another aspect of the present invention provides a table saw guard assembly having independently removable side curtains. Still another aspect of the present invention provides a table saw guard assembly having a support structure, which enables the table saw guard assembly to be easily removed from the working area. A still further aspect of the present invention provides a table saw guard assembly having a locking mechanism for securing the guard at a fixed position above the table saw. It is yet a further aspect of the present invention to provide a table saw guard assembly, which provides an unimpeded view of the workpiece and the table saw blade during operation.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DRAWINGS

The present invention will become more fully understood from the detailed description and the accompanying drawings, wherein.

DETAILED DESCRIPTION

The following description of the preferred embodiments is merely exemplary in nature and is in no way intended to limit the scope of the present invention, its application, or its uses.

With reference to FIGS. 1-5, a first embodiment of a table saw guard assembly 12 in accordance with the present invention is presented. The table saw guard assembly 12 generally includes a support structure and a hood assembly supported above a saw blade 14 by the support structure. The support structure generally includes a riving knife 10 having an aperture 16 therethrough located immediately behind the saw blade 14.

Figure 5:
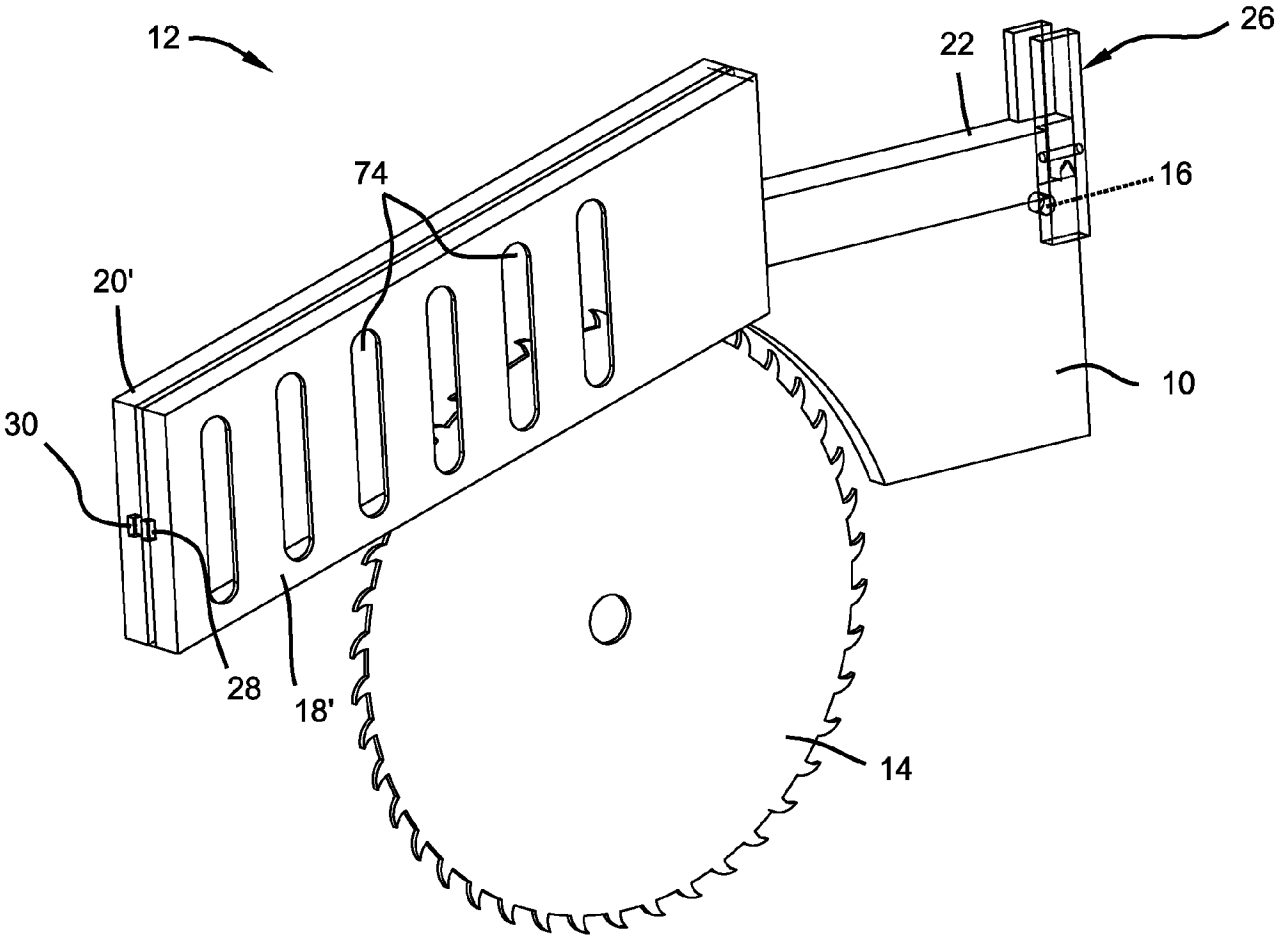
FIG. 5 is a perspective view of an alternative embodiment of the table saw guard assembly of FIG. 1.
Figure 6:
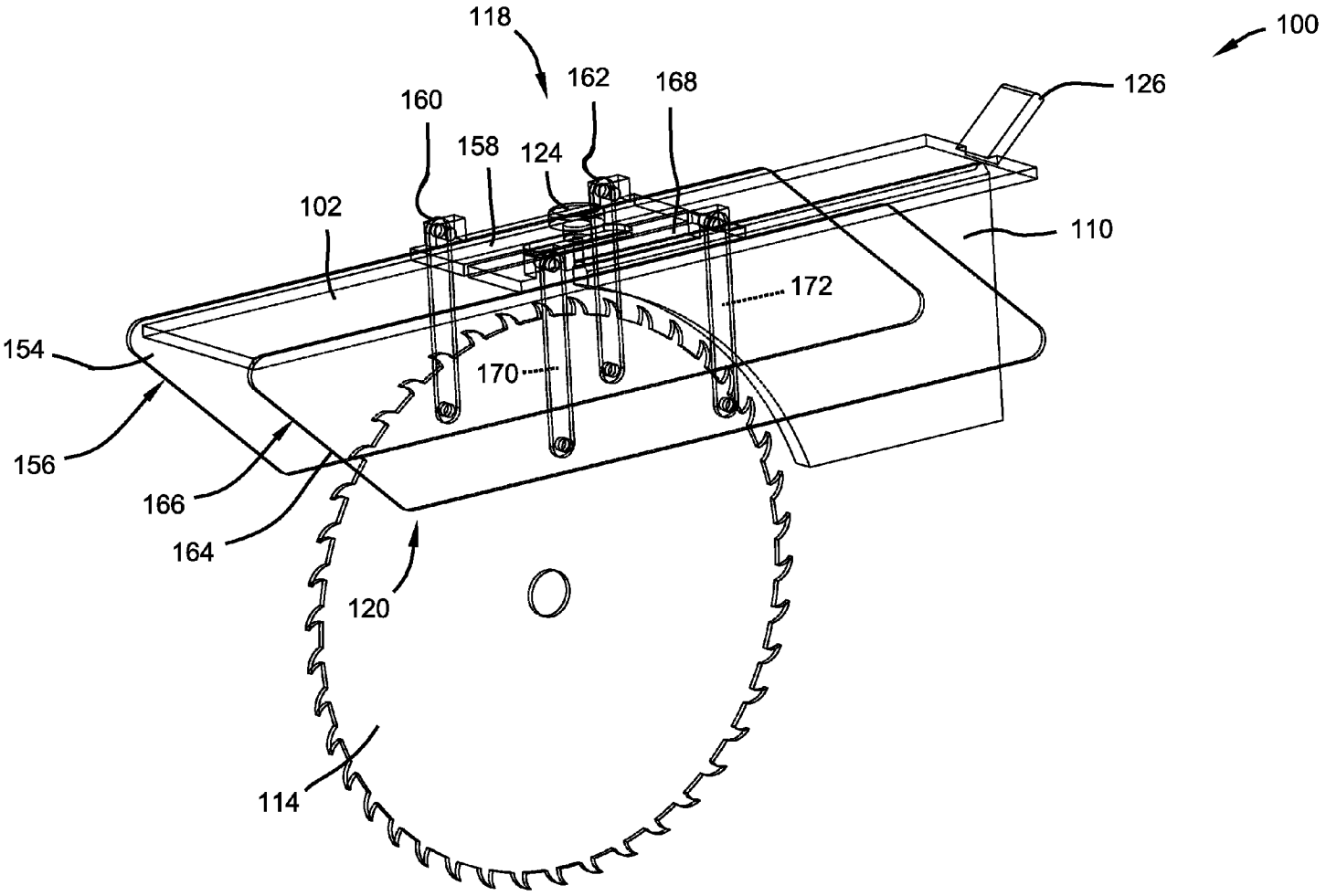
FIG. 6 is a perspective view of a second embodiment of the table saw guard assembly of the present invention.
Figure 7:
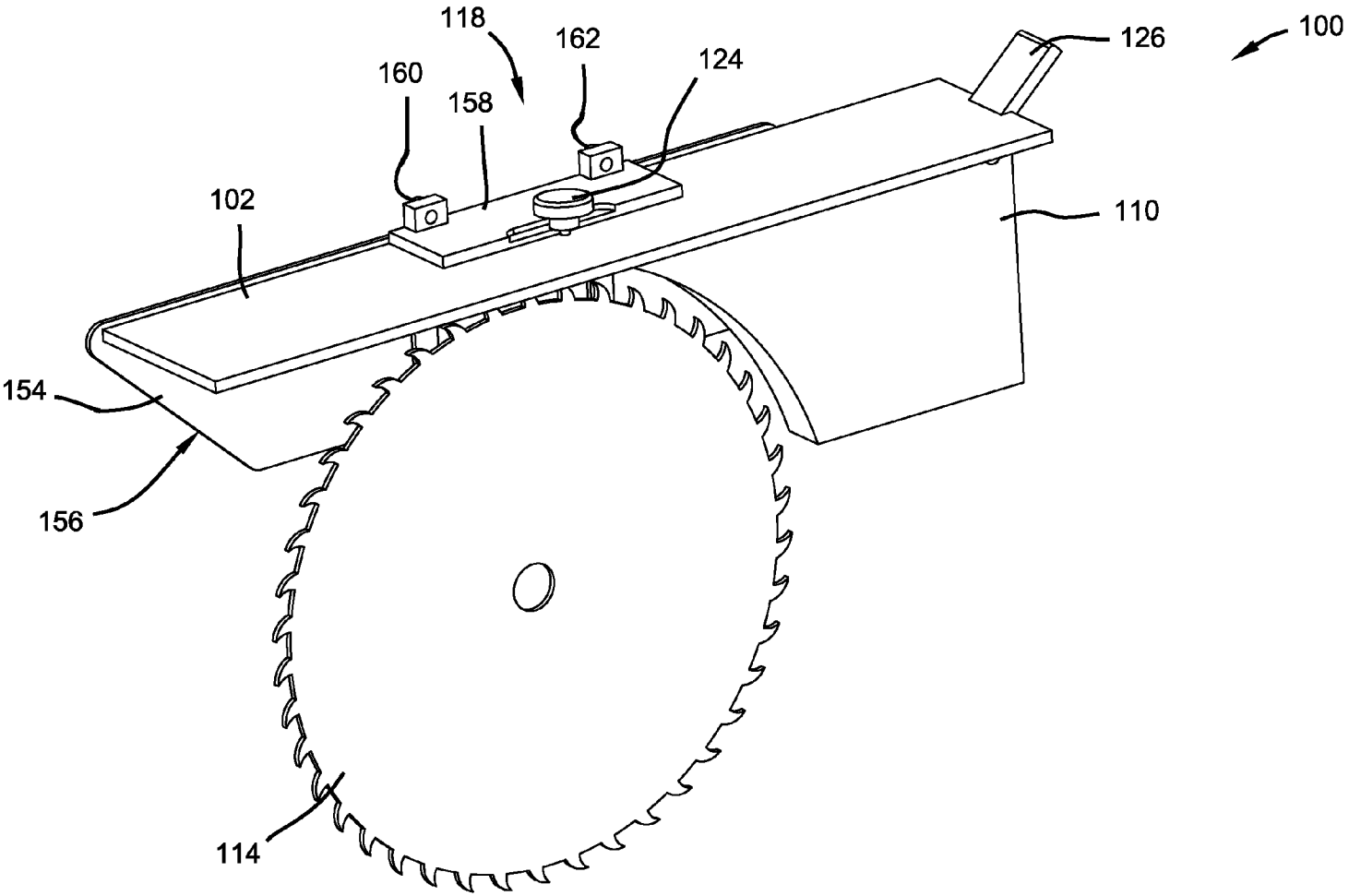
FIG. 7 is a perspective view of the table saw guard assembly of FIG. 6, wherein one side assembly is removed therefrom.
Figure 8:
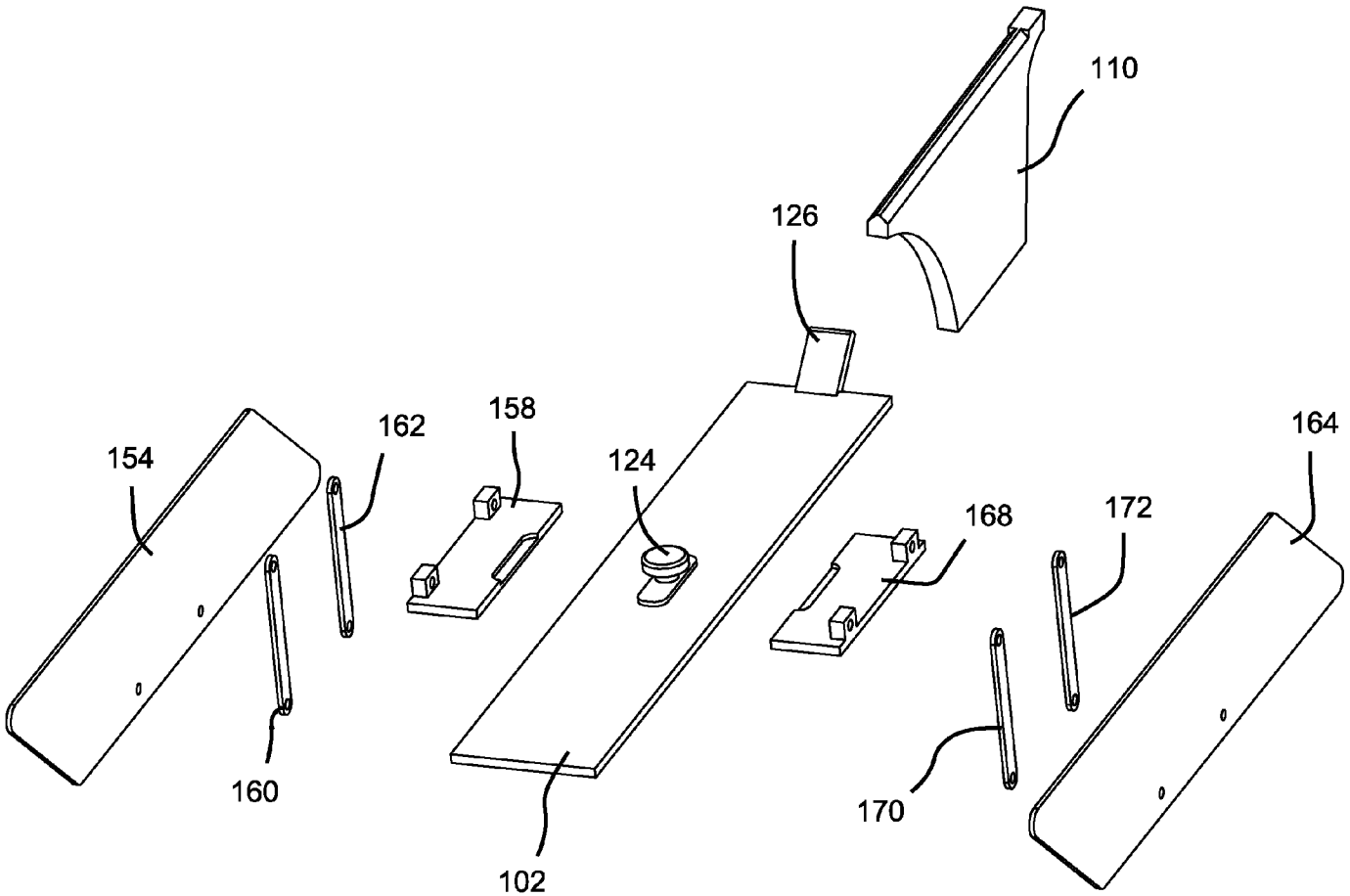
FIG. 8 is an exploded perspective view of the table saw guard assembly of FIG. 6.

The hood assembly includes a first side curtain 18, a second side curtain 20, a mounting member 22, a first locking mechanism 24, and a second locking mechanism 26. In a presently preferred embodiment, the first and second side curtains 18, 20 include transparent bodies. In an alternative embodiment, the first and second side curtains 18', 20' include bodies having a plurality of apertures 74 therethrough (as shown in FIG. 5). Furthermore, the first side curtain 18 includes a first coupler 28 and the second side curtain 20 includes a second coupler 30. In a presently preferred embodiment, the first coupler 28 includes a female snap-fit connector and the second coupler 30 includes a male snap-fit connector adapted to selectively interconnect with the first coupler 28. Engaging the first and second couplers 28, 30 provides for co-dependent movement of the first and second side curtains 18, 20.

The first locking mechanism 24 is provided for pivotally connecting the first and second side curtains 18, 20 to the mounting member 22. The first locking mechanism 24 includes a screw 32 and a wing nut 34 threadably engaging the screw 32, and is further adapted to enable selective removal of the first and second side curtains 18, 20. The mounting member 22 includes a solid member having an aperture 36 disposed horizontally therethrough for receiving the screw 32 of the first locking mechanism 24.

Figure 4:
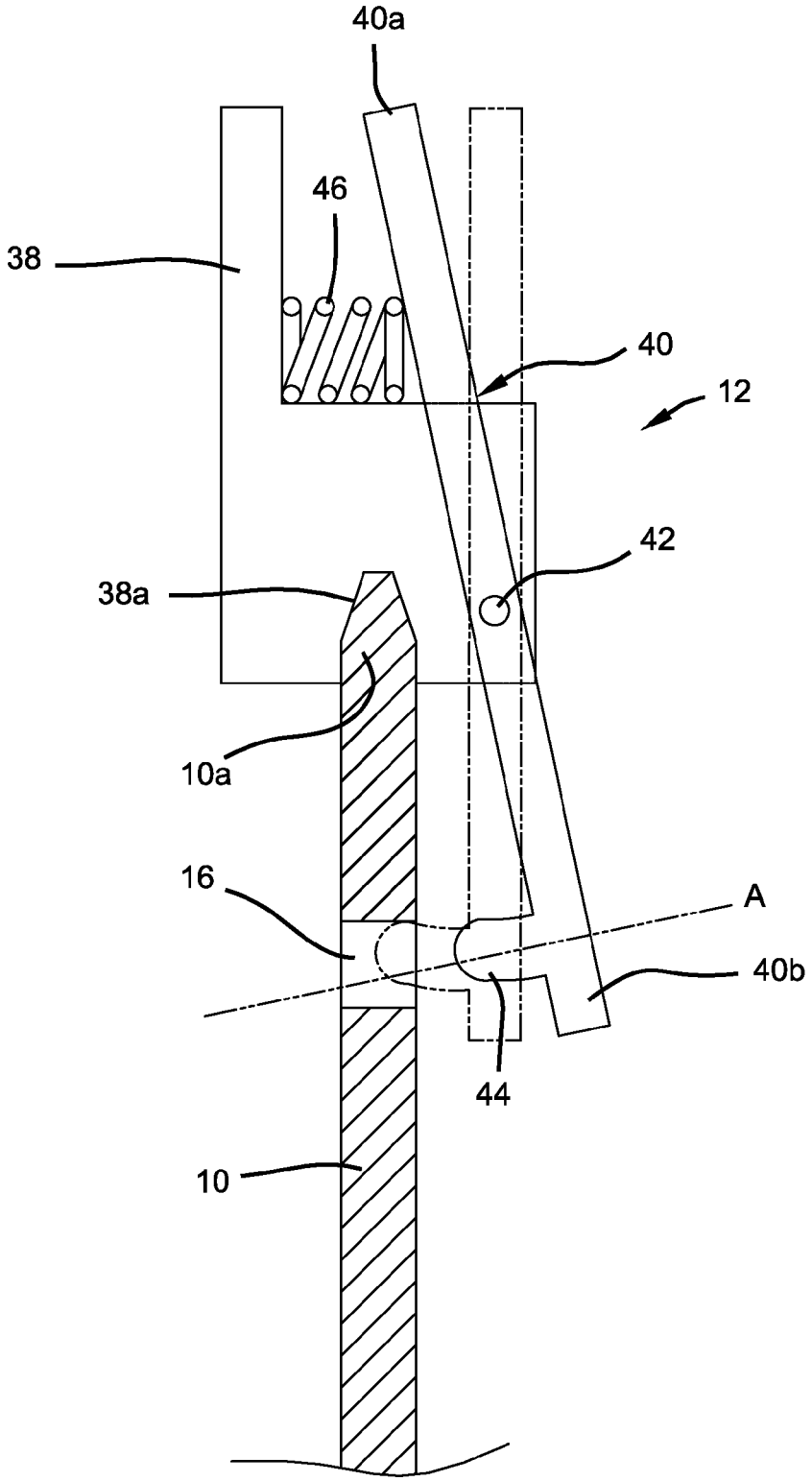
FIG. 4 is a cross sectional view of a first embodiment of a quick release mechanism for attaching a hood assembly to a support structure of the present invention.

With specific reference to FIG. 4, the second locking mechanism 26 is attached toward a backside of the mounting member 22 and includes a quick release mechanism. The quick release mechanism includes a block 38 and a lever 40 operably attached to a pivot pin 42. The block 38 includes a v-shaped recess 38*a* formed in an underside thereof for engaging a v-shaped edge 10*a* on the riving knife 10. The lever 40 is operable between an open position and a closed position (shown in phantom in FIG. 4). The lever 40 includes a top end 40*a* and a bottom end 40*b* having a lock pin 44 extending from an inner side thereof for selectively engaging the aperture 16 in the riving knife 10. The lock pin 44 extends from the lever 40 at a slight angle upward relative an axis A, such that when the lock pin 44 enters the aperture 16, it engages a top surface of the aperture 16 and biases the hood assembly onto the riving knife 10. The mechanism further includes a coil spring 46 disposed between the block 38 and the upper end 40*a* of the lever 40 for biasing the lever 40 in the closed position. In another embodiment, the second quick release mechanism includes a spring biased lock member adapted to engage the riving knife 10 as described below in reference to FIG. 9.

Figure 1:
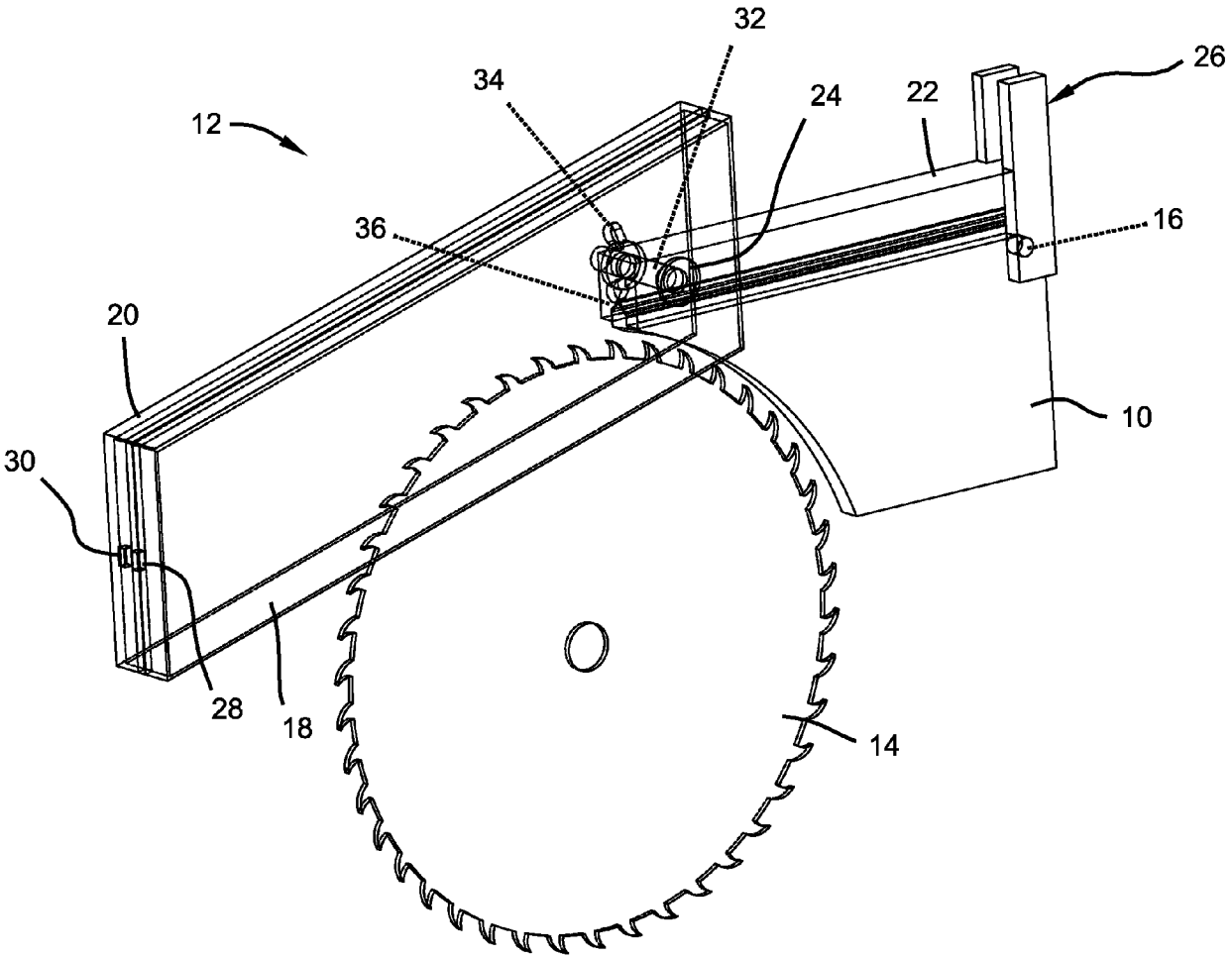
FIG. 1 is a perspective view of a first embodiment of the table saw guard assembly of the present invention.
Figure 2:
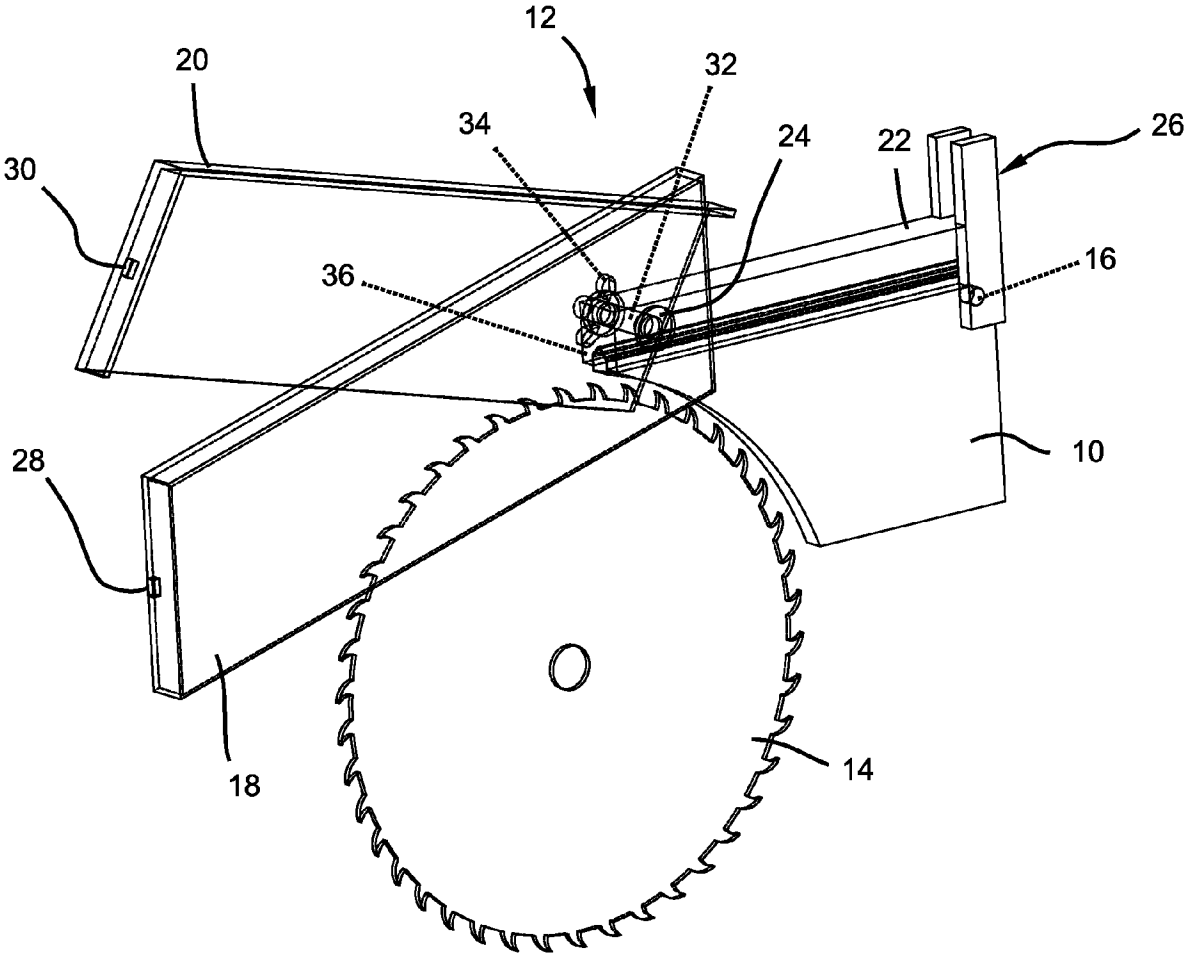
FIG. 2 is a perspective view of the table saw guard assembly of FIG. 1, wherein one side curtain is fixed at a position different from the other side curtain.
Figure 3:
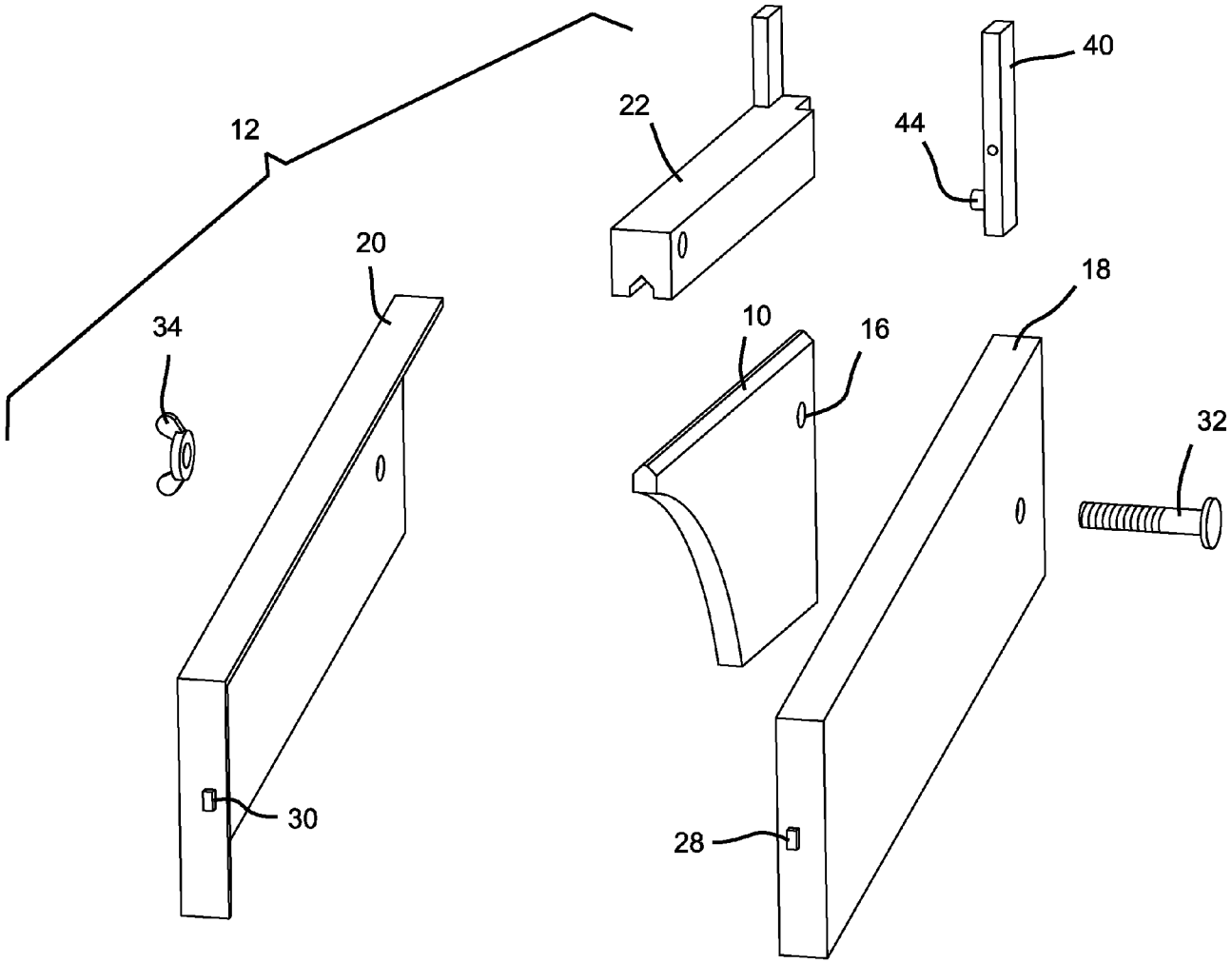
FIG. 3 is an exploded perspective view of the table saw guard assembly of FIG. 1.

During operation, the wing nut 34 of the first locking mechanism 24 is loosened to allow one (as shown in FIG. 2) or both (as shown in FIG. 1) of the first and second side curtains 18, 20 to be pivotally adjusted. Thereafter, the wing nut 34 is tightened to secure the first and second side curtains 18, 20 in a predetermined position. Furthermore, the wing nut 34 may be removed from the screw 32 and the screw removed from the aperture 36 in the mounting member 22 to allow one or both of the side curtains 18, 20 to be removed therefrom. Lastly, the entire hood assembly 12 is removed from the support structure by disengaging the second locking mechanism 26. Disengagement is accomplished by squeezing the top end 40*a* of the push tab 40 thereby pivoting the push tab 40 about the pivot pin 42 toward the open position and extracting the lock pin 44 from the aperture 16 in the riving knife 10. Thereafter, the hood assembly is raised off of the riving knife 10.

With reference to FIGS. 6-11, a second embodiment of a table saw guard assembly 100 is presented including a support structure and a hood assembly supported above a saw blade 114 by the support structure. The support structure generally includes a riving knife 110 having a shoulder 150 (best shown in FIG. 9) formed thereon located immediately behind the saw blade 114.

Figure 11:
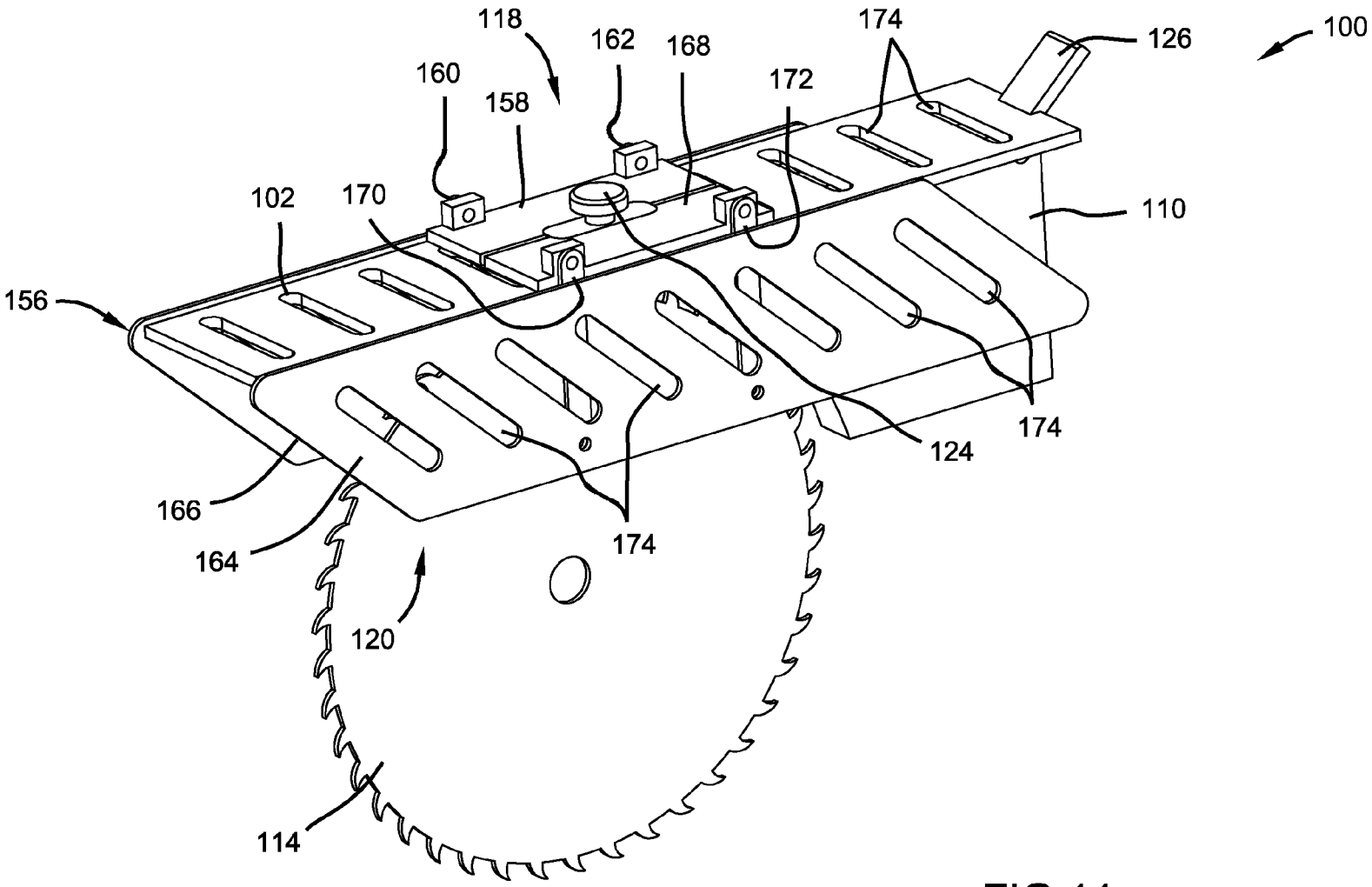
FIG. 11 is a perspective view of an alternative embodiment of the table saw guard assembly of FIG. 6.

The hood assembly includes a top curtain 102, a first side assembly 118, a second side assembly 120, a first locking mechanism 124, and a second locking mechanism 126. In a presently preferred embodiment, the top curtain 102 includes a transparent body and is disposed above the saw blade 114. The first side assembly 118 includes a first side curtain 154 having a transparent body and a first chamfered front edge 156, a first engagement plate 158, and first and second link arms 160, 162 connecting the first side curtain 154 to the first engagement plate 158. The second side assembly 120 includes a second side curtain 164 having a transparent body and a second chamfered front edge 166, a second engagement plate 168, and third and fourth link arms 170, 172 connecting the second side curtain 164 to the second engagement plate 168. In an alternative embodiment, the top curtain 102 and first and second side curtains 154, 164 each include a plurality of apertures 174 therethrough for providing a sight line to the saw blade 114 (as shown in FIG. 11).

Figure 10:
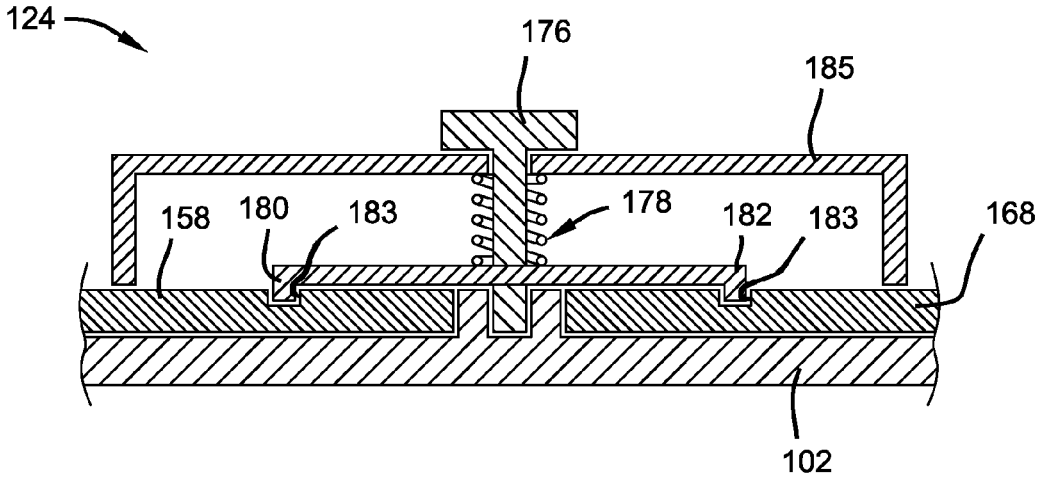
FIG. 10 is a cross sectional detail view of an embodiment of a quick release mechanism for attaching the side assemblies to the top curtain of the table saw guard assembly of FIG. 6.

With specific reference to FIG. 10, the first locking assembly 124 includes a first quick release mechanism for independently and selectively attaching the first and second engagement plates 158, 168 of the first and second side assemblies 118, 120, respectively, to the top curtain 102. The first quick release mechanism includes a pull pin 176 biased downward by a coil spring 178, a first hook arm 180 and a second hook arm 182. The first and second hook arms 180, 182 are adapted to engage recesses 183 provided in the first and second engagement plates 158, 168, respectively, thereby securing the side assemblies 118, 120 to the top curtain 102. The first locking assembly 124 includes an upper housing member 185 mounted to the top curtain 102 for supporting the pull pin 176 and first and second hook arms 180, 182.

Figure 9:
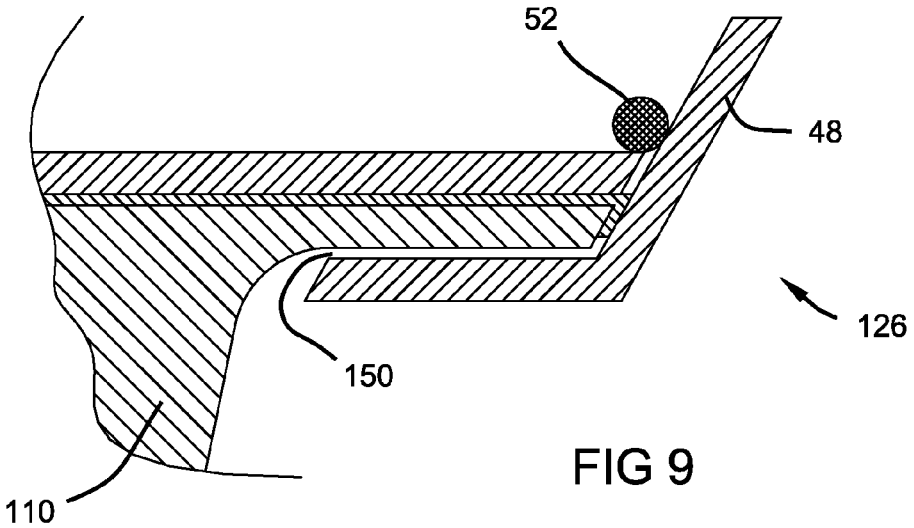
FIG. 9 is a cross sectional detail view of a second embodiment of a quick release mechanism for attaching a hood assembly to a support structure of the table saw guard assembly of FIG. 6.

With specific reference to FIG. 9, a presently preferred embodiment of the second locking mechanism 126 includes a second quick release mechanism disposed at a rear side of the top curtain 102. The second quick release mechanism includes a lock member 48 adapted to engage the shoulder 150 on the riving knife 110 and a spring biased hinge 52 for biasing the lock member 48 against the shoulder 150 of the riving knife 110.

In an alternative embodiment, the second quick release mechanism includes a block 38 and a lever 40 operably attached to a pivot pin 42, as described above with reference to FIG. 4. The block 38 includes a v-shaped recess 38*a* formed in an underside thereof for engaging a v-shaped edge 10*a* on the riving knife 110. The lever 40 is operable between an open position and a closed position (shown in phantom in FIG. 4). The lever 40 includes a top end 40*a* and a bottom end 40*b* having a lock pin 44 extending from an inner side thereof for selectively engaging the aperture 16 in the riving knife 110. The lock pin 44 extends from the lever 40 at a slight angle upward relative an axis A, such that when the lock pin 44 enters an aperture 16, it engages a top surface of the aperture 16 and biases the hood assembly 100 onto the riving knife 110. The mechanism further includes a coil spring 46 disposed between the block 38 and the upper end 40*a* of the lever 40 for biasing the lever 40 in the closed position.

During operation, a workpiece enters the hood assembly applying a force to the first and second chamfered front edges 156, 166 of the first and second side curtains 154, 164, thereby causing the first and second side curtains 154, 164 to independently pivot on the respective link members 160, 162 and 170, 172 relative to the top curtain 102.

In an alternative operational environment, the pull pin 176 of the first quick release mechanism is raised, thereby disengaging the first and second hook arms 180, 182 from the first and second engagement plates 158, 168. This enables one or both of the first and second side assemblies 118, 120 to be independently removed from the top curtain 102. Thereafter, the pull pin 176 is released and the coil spring 178 biases the first and second hook arms 180, 182 back down to engage the remaining engagement plate(s) 158, 168. It should be appreciated that while a coil spring is disclosed to bias the pull pin downward, other biasing means, such as a camlock, useful to achieve a similar result are intended to be within the scope of the present invention.

In yet another operational environment, the lock member 48 of the second quick release mechanism as shown in FIG. 9 is pivoted, thereby disengaging the riving knife 50 and enabling the entire hood assembly 100 to be removed therefrom.

Figure 12:
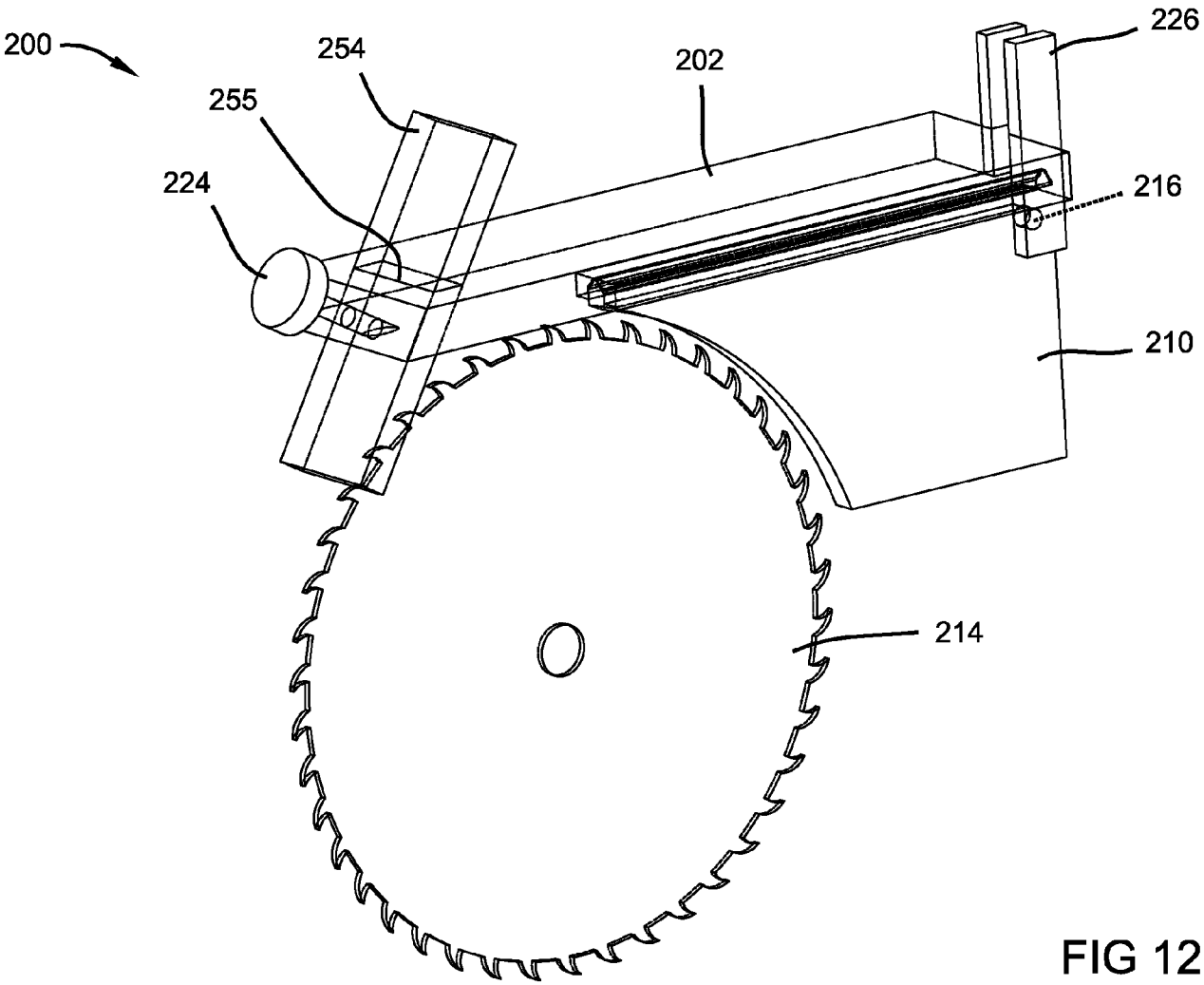
FIG. 12 is a perspective view of a third embodiment of the table saw guard assembly of the present invention.
Figure 13:
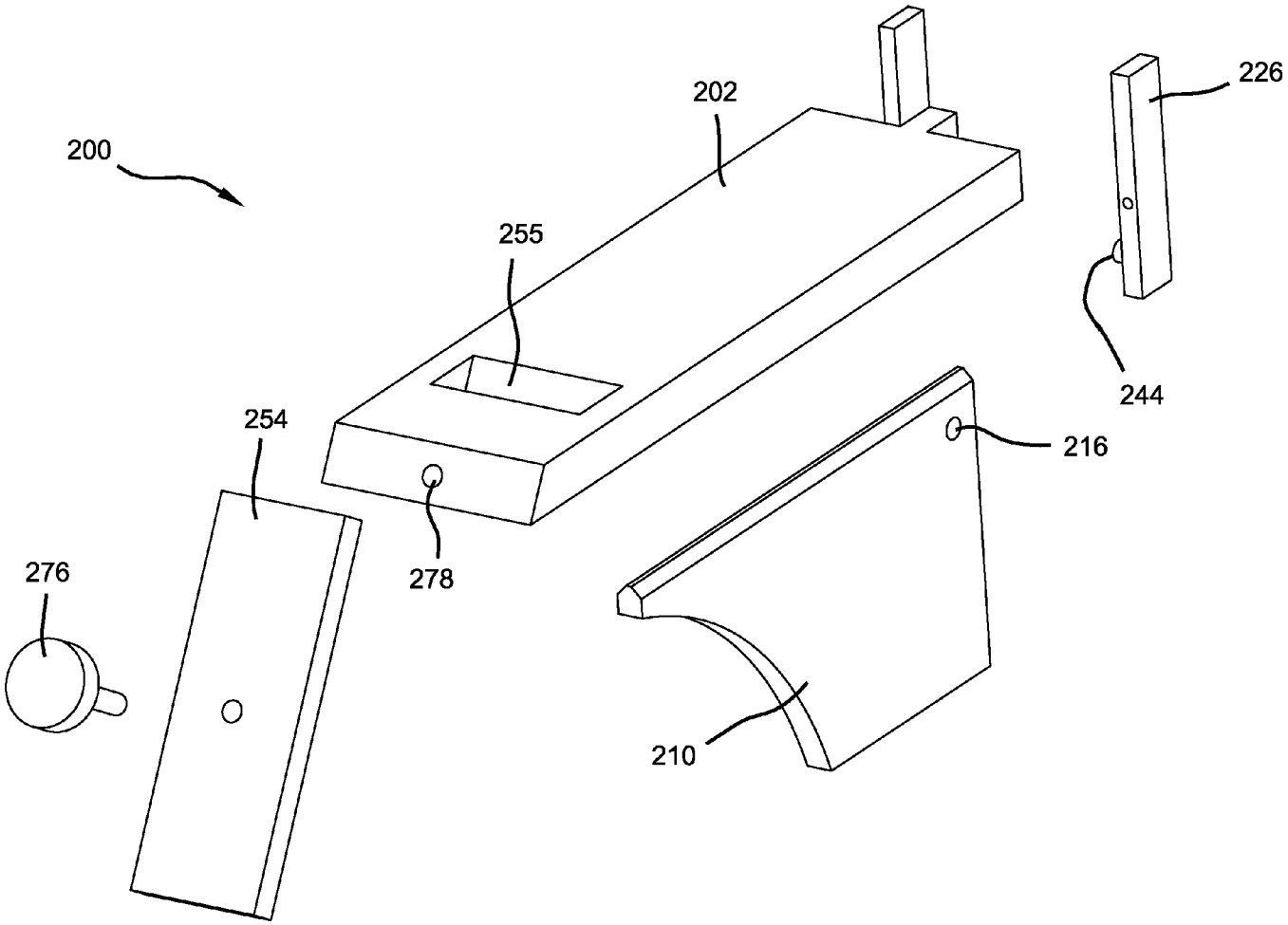
FIG. 13 is an exploded perspective view of the table saw guard assembly of FIG. 12.
Figure 14:
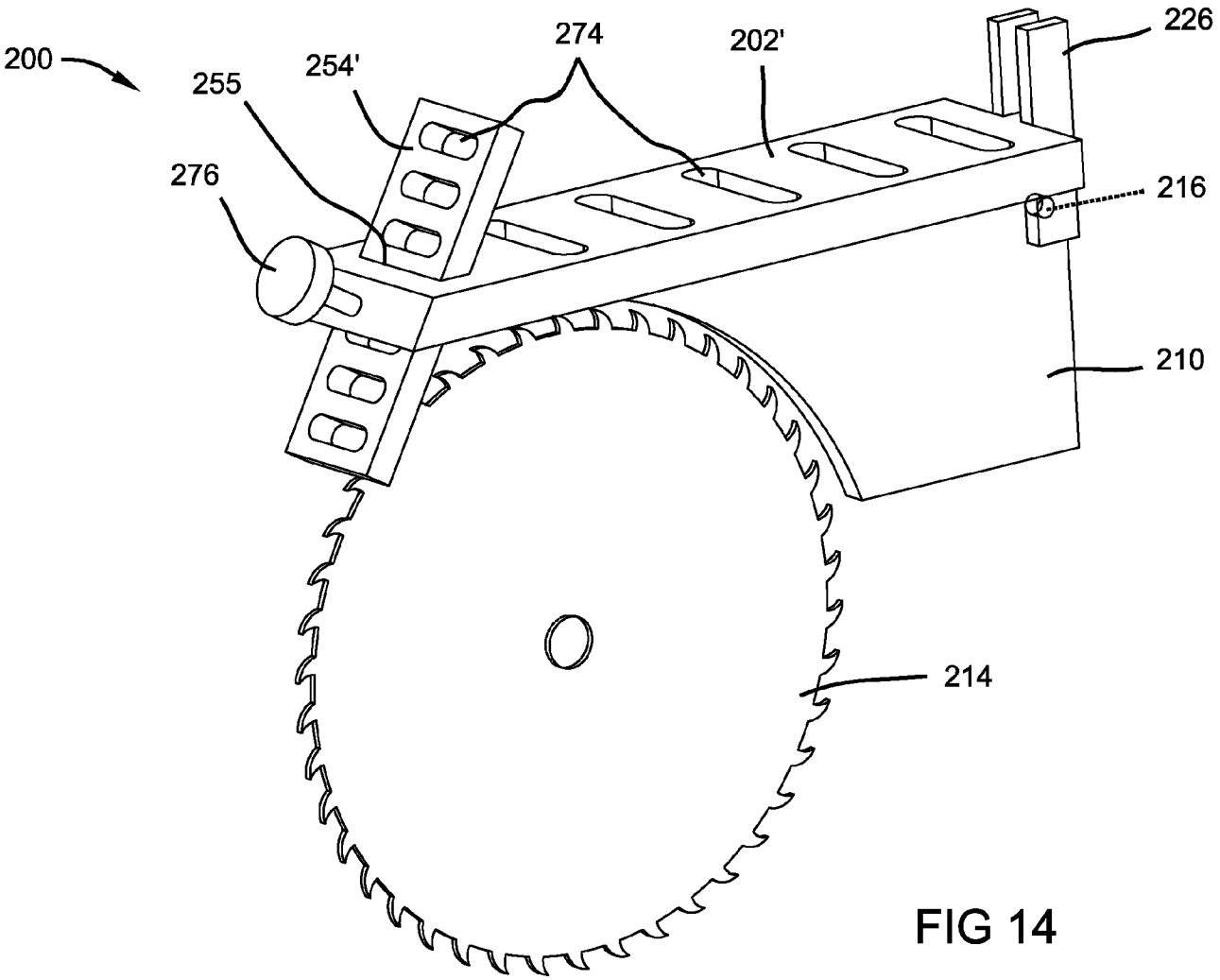
FIG. 14 is a perspective view of an alternative embodiment of the table saw guard assembly of FIG. 12.

Now with reference to FIGS. 12-14, a third embodiment of a table saw guard assembly 200 in accordance with the present invention is presented including a support structure and a hood assembly supported above a saw blade 214 by the support structure. The support structure generally includes a riving knife 210 having an aperture 216 therethrough located immediately behind the saw blade 214.

The hood assembly 200 includes a top curtain 202, a front curtain 254, a first locking mechanism 224, and a second locking mechanism 226. In a presently preferred embodiment, the top curtain 202 includes a transparent body disposed above the saw blade 214, and the front curtain 254 includes a transparent body disposed at a slight incline in front of the saw blade 214 and through a slot 255 in the top curtain 202. In an alternative embodiment, shown in FIG. 14, the top and front curtains 202', 254' each include a plurality of apertures 274 therethrough for providing a sight line to the saw blade 214. The first locking mechanism 224 slidably attaches the front curtain 254 to the top curtain 202. The first locking mechanism 224 includes a thumb screw 276 for being received in a threaded aperture 278 in the top curtain 202 and engaging the front curtain 254.

In a presently preferred embodiment, the second locking mechanism 226 includes a quick release mechanism for selectively engaging the riving knife 210. With reference to FIG. 4, the quick release mechanism 226 includes a block 38 and a lever 40 operably attached to a pivot pin 42. The block 38 includes a v-shaped recess 38*a* formed in an underside thereof for engaging a v-shaped edge 10*a* on the riving knife 210. The lever 40 is operable between an open position and a closed position (shown in phantom in FIG. 4). The lever 40 includes a top end 40*a* and a bottom end 40*b* having a lock pin 44 extending from an inner side thereof for selectively engaging the aperture 216 in the riving knife 210. The lock pin 44 extends from the lever 40 at a slight angle upward relative an axis A, such that when the lock pin 44 enters the aperture 216, it engages a top surface of the aperture 216 and biases the hood assembly onto the riving knife 210. The mechanism further includes a coil spring 46 disposed between the block 38 and the upper end 40*a* of the lever 40 for biasing the lever 40 in the closed position. In an alternative embodiment, the second quick release mechanism includes a lock member 48 adapted to engage a shoulder 50 of the riving knife 210 and a spring biased hinge 52 for biasing the lock member against the shoulder 50 on the riving knife 210 (as shown in FIG. 9).

During operation, the thumb screw 276 is loosened, thereby enabling the front curtain 254 to slide relative to the top curtain 202 so that the front curtain 254 can be adjusted to a height of a work piece. Thereafter, the thumbscrew 276 is tightened to engage the front curtain 254 and secure it in a predetermined position.

In an alternative operational environment, the entire hood assembly 200 is removed from the support structure by disengaging the quick release mechanism 226. Disengagement is accomplished by squeezing the top end of the lever 40 toward the block 38, thereby pivoting the lever 40 about the pivot pin 42 toward the open position and extracting the lock pin 44 from the aperture 216 in the riving knife 210. Thereafter, the hood assembly 200 is raised off of the riving knife 210.

Figure 15:
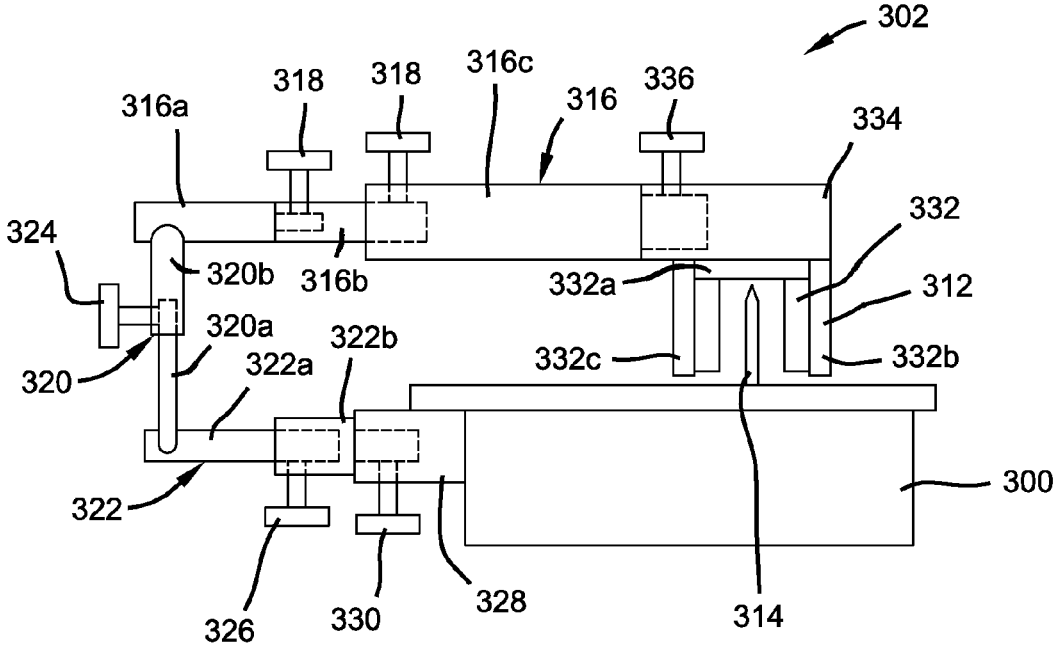
FIG. 15 is a front elevational view of a fourth embodiment of the table saw guard assembly of the present invention.
Figure 16:
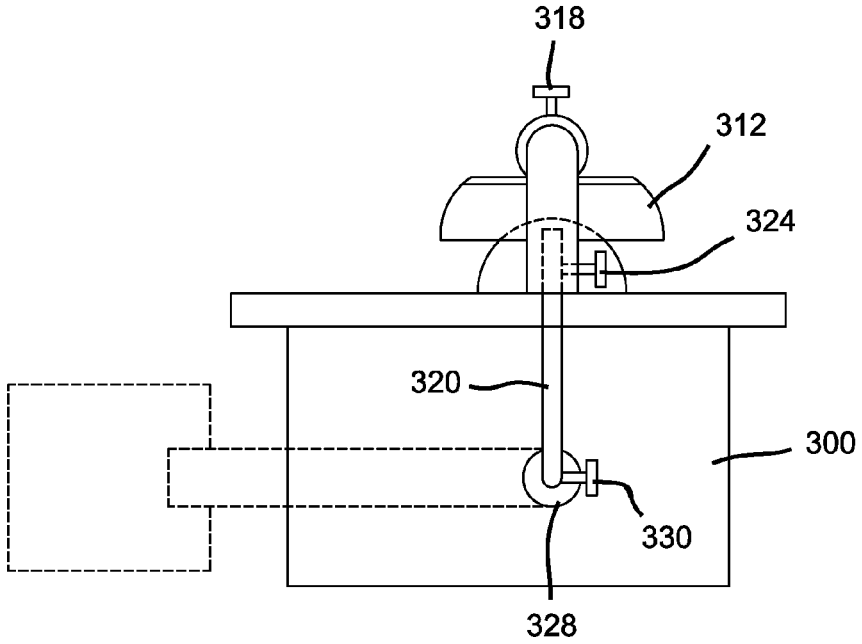
FIG. 16 is a side elevational view of the table saw guard assembly of FIG. 15.

With reference to FIGS. 15 and 16, a fourth embodiment of the table saw guard assembly of the present invention is presented adapted to a table saw 300 having a circular saw blade 314. The table saw guard assembly 302 generally includes a support structure and a hood assembly 312 supported above the saw blade 314 by the support structure. The support structure includes a telescoping boom 316 and a base structure. The telescoping boom 316 includes three interconnecting sleeve members 316*a*, 316*b*, 316*c* and a pair of set screws 318 for adjusting the length and/or rotational orientation of the telescoping boom 316. The base structure includes a telescoping vertical arm assembly 320 and a telescoping horizontal arm assembly 322. The vertical arm assembly 320 includes two interconnected sleeve members 320*a*, 320*b* and a set screw 324 for adjusting the length and/or rotational orientation of the vertical arm assembly 320. The horizontal arm assembly 322 also includes two interconnected sleeve members 322*a*, 322*b* and a set screw 326 for adjusting the length and/or rotational orientation of the horizontal arm assembly 322.

The base structure further includes a rotational mechanism 328 disposed between the horizontal arm assembly 322 and the table saw 300. The rotational mechanism 328 includes a set screw 330 for enabling the entire support structure to rotate from a first position, wherein the hood assembly 312 is supported above the saw blade, to a second position, wherein the hood assembly 312 is pivoted and supported away from the saw blade, as illustrated in phantom lines in FIG. 16.

Figure 17:
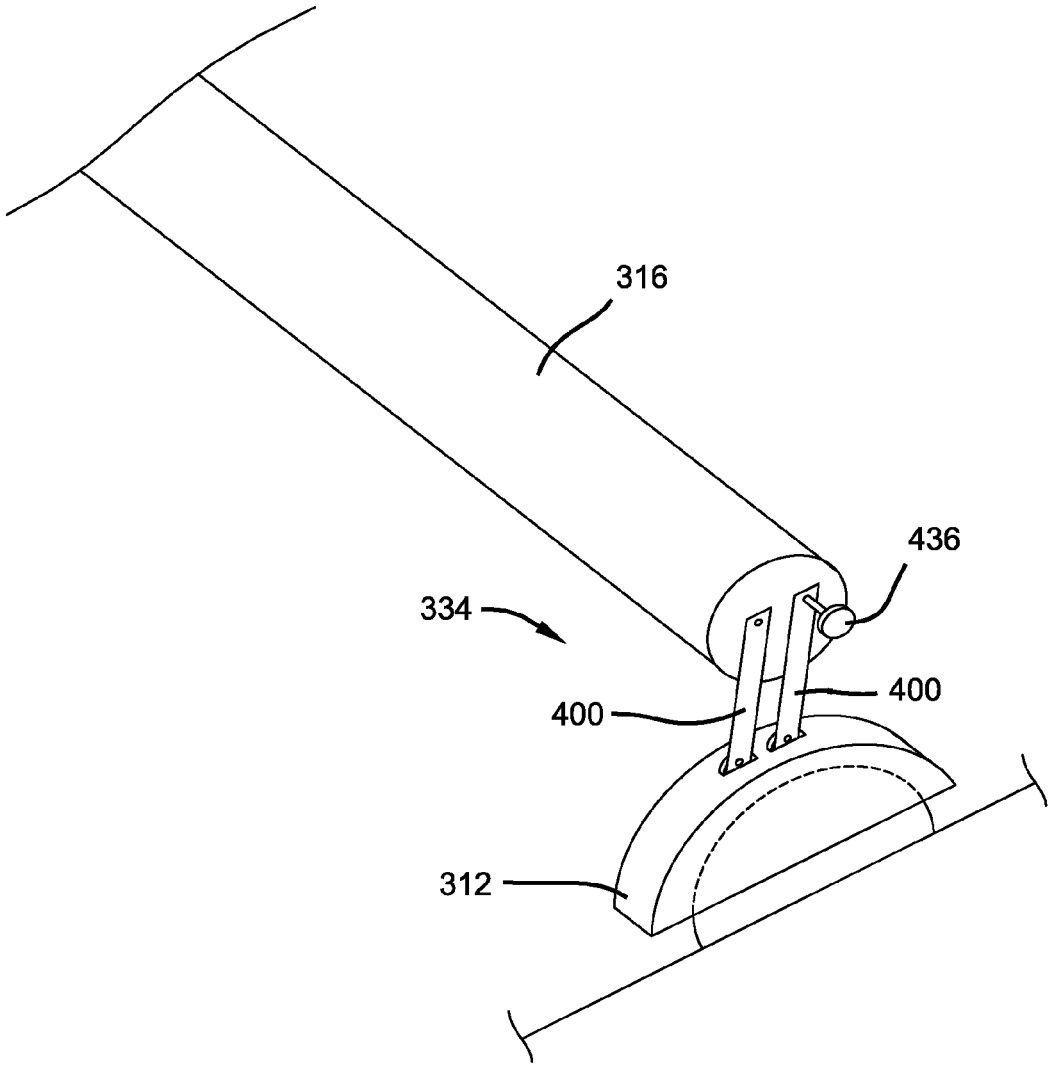
FIG. 17 is a perspective view of an alternative embodiment of a mounting assembly of a fourth embodiment of the present invention.

The hood assembly includes a guard 332 and a mounting assembly 334. The guard 332 generally includes a top curtain 322*a* and two side curtains 332*b*, 332*c* for guarding against accidental engagement with the saw blade 14. In a presently preferred embodiment, the mounting assembly 334 includes a rotational coupling operably connected to the telescoping boom 316 for enabling the hood 312 to rotate relative to the telescoping boom 316. In another embodiment, shown in FIG. 17, the mounting assembly 334 includes a set of linkages 400 operably connecting the hood assembly to the telescoping boom 316 and enabling the guard 312 to pivot relative to the telescoping boom 316. The mounting assembly 334 further includes a set screw 436 disposed thereon for securing the hood assembly 312 in a variety of predetermined positions about the telescoping boom 316.

During operation, the hood assembly 316 may be secured in a variety of configurations. The set screw 336 on the mounting assembly 334 may be loosened, thereby enabling the hood assembly 312 to rotate around the telescoping boom 316 away from the saw blade 314. This increases the workspace near the saw blade 314 without requiring timely disassembly of the entire hood assembly 312. In addition, the set screws 318, 324, 326 on the telescoping boom 316, the horizontal arm 322, and vertical arm 320 may be loosened to enable adjustment thereof. This also increases the workspace near the saw blade 314 without requiring timely disassembly. Moreover, the set screw 330 on the rotational mechanism 328 can be loosened, thereby enabling the entire support structure to be rotated to a side of the table saw 300, as illustrated in phantom in FIG. 16. In addition to creating a larger workspace, this configuration also compacts the table saw 300, thus providing for easier transportation and storage.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A table saw guard assembly for guarding a blade on a table saw, said guard assembly comprising:

a riving knife; and a hood assembly mounted to said riving knife including a first side curtain and a second side curtain, wherein each of said first and second side curtains are independently movable relative to said riving knife, wherein said first and second side curtains include a plurality of apertures for providing a sight line therethrough.

2. The guard assembly of claim 1, wherein said hood assembly further includes a quick-release mechanism for selectively engaging said hood assembly to said riving knife.

3. A table saw guard assembly for guarding a blade on a table saw, said guard assembly comprising:

a riving knife; and a hood assembly mounted to said riving knife including a first side curtain and a second side curtain, wherein each of said first and second side curtains are independently movable relative to said riving knife, wherein said first and second side curtains include an aperture for providing a sight line therethrough, wherein said hood assembly further includes a quick-release mechanism for selectively engaging said riving knife, wherein said quick-release mechanism includes a fixed tab and a push tab pivotally connected to a pivot pin, wherein said push tab includes a lock pin and said riving knife includes an aperture for receiving said lock pin.

4. The guard assembly of claim 1, wherein said hood assembly further includes a locking mechanism adapted to selectively engage and secure said at least one of said first and second side curtains.

5. The guard assembly of claim 4, wherein said locking assembly includes a screw and a wing nut.

6. The guard assembly of claim 1, wherein said first and second side curtains independently move in response to a force applied by a workpiece.

7. The guard assembly of claim 4, wherein said first and second side curtains are moveable in accordance with said engagement of said locking mechanism.

8. The guard assembly of claim 1, wherein said first side curtain includes a first coupler, and said second curtain includes a second coupler adapted to engage said first coupler thereby connecting said first and second side curtains.

9. A table saw guard assembly for guarding a blade on a table saw, said guard assembly comprising:

a riving knife; and a hood assembly mounted to said riving knife including a first side curtain and a second side curtain, wherein each of said first and second side curtains are independently movable relative to said riving knife, wherein said first and second side curtains include an aperture for providing a sight line therethrough, wherein said first side curtain includes a first coupler, and said second curtain includes a second coupler adapted to engage said first coupler thereby connecting said first and second side curtains, wherein said first coupler includes a female snap-fit connector and said second coupler includes a male snap-fit connector adapted to selectively interconnect with the first coupler providing for codependent movement of said first and second side curtains.

10. The guard assembly of claim 1, wherein each of said first and second side curtains are independently removable from said hood assembly.

11. A table saw guard assembly for guarding a blade on a table saw, said guard assembly comprising:

a support structure; and a hood assembly mounted to said support structure including a first side curtain and a second side curtain, wherein each of said first and second side curtains are independently movable relative to said support structure, wherein said first and second side curtains include an aperture for providing a sight line therethrough, wherein said hood assembly further includes a quick-release mechanism for selectively engaging said support structure, wherein said quick-release mechanism includes a fixed tab and a push tab pivotally connected to a pivot pin, wherein said push tab includes a lock pin and said support structure includes an aperture for receiving said lock pin.

12. A table saw guard assembly for guarding a blade on a table saw, said guard assembly comprising:

a support structure; and a hood assembly mounted to said support structure including a first side curtain and a second side curtain, wherein each of said first and second side curtains are independently movable relative to said support structure, wherein said first and second side curtains include an aperture for providing a sight line therethrough, wherein said hood assembly further includes a quick-release mechanism for selectively engaging said support structure, wherein said quick-release mechanism includes a fixed tab and a push tab pivotally connected to a pivot pin wherein said first side curtain includes a first coupler, and said second curtain includes a second coupler adapted to engage said first coupler thereby connecting said first and second side curtains, wherein said first coupler includes a female snap-fit connector and said second coupler includes a male snap-fit connector adapted to selectively interconnect with the first coupler providing for codependent movement of said first and second side curtains.

* * * * *